US005858129A

United States Patent [19]

Kobayashi et al.

[11] Patent Number: 5,858,129

[45] Date of Patent: Jan. 12, 1999

[54] AUSTENITE STAINLESS STEEL

[75] Inventors: Yutaka Kobayashi; Takeya Toge; Yoshito Fujiwara, all of Kawasaki, Japan

[73] Assignee: Nippon Yakin Kogyo Co., Ltd., Tokyo, Japan

[21] Appl. No.: 903,103

[22] Filed: Jul. 30, 1997

[30] Foreign Application Priority Data

Aug. 15, 1996 [JP] Japan ..... 8-233582

[51] Int. Cl.[6] ..... C22C 38/38

[52] U.S. Cl. ..... 148/327; 148/330; 148/442; 420/52; 420/64; 420/96; 420/97; 420/121; 420/128; 420/586.1

[58] Field of Search ..... 148/327, 330, 148/442; 420/52, 64, 96, 97, 121, 128, 586.1

[56] References Cited

U.S. PATENT DOCUMENTS

| | | | |
|---|---|---|---|
| 4,487,744 | 12/1984 | BeBold et al. | 420/586.1 |
| 4,505,232 | 3/1985 | Usami et al. | 420/52 |
| 4,554,028 | 11/1985 | DeBold et al. | 148/327 |
| 5,543,109 | 8/1996 | Senbu et al. | 148/442 |

FOREIGN PATENT DOCUMENTS

| | | |
|---|---|---|
| 55-107762 | 8/1980 | Japan . |
| 61-163247 | 7/1986 | Japan . |
| 62-192530 | 8/1987 | Japan . |
| 1-47817 | 2/1989 | Japan . |
| 1-259143 | 10/1989 | Japan . |
| 06128699 | 5/1994 | Japan . |
| 08104952 | 4/1996 | Japan . |
| 08104953 | 4/1996 | Japan . |

*Primary Examiner*—John Sheehan
*Attorney, Agent, or Firm*—Thompson Hine & Flory LLP

[57] ABSTRACT

Disclosed is an austenite stainless steel comprising: no more than 0.05% by weight of C; no more than 0.25% by weight of Si; no more than 0.40% by weight of Mn; no more than 0.040% by weight of P; no more than 0.003% by weight of S; 30.0 to 40.0% by weight of Ni; 20.0 to 26.0% by weight of Cr; 5.0 to 8.0% by weight of Mo; no more than 0.1% by weight of Al; 0.001 to 0.010% by weight of B; 0.15 to 0.30% by weight of N; and balance of Fe and inevitable impurity. The austenite stainless steel satisfying formula (1) and (2) mentioned below (wherein "Cr", "Mo", "N", "Si" and "Mn" mean content of each element).

$$Cr+3.3Mo+20N \geqq 51 \quad (1)$$

$$5Si+Mn<32-(Cr+Mo) \quad (2)$$

9 Claims, 2 Drawing Sheets

AUSTENITE STAINLESS STEEL

BACKGROUND OF THE INVENTION

1. Field of the Invention

The present invention relates to an improvement of austenite stainless steel having high crevice corrosion resistance and hot workability, and advantageously used for various parts, for example parts used in seawater or a flue gas desulfurization apparatus.

2. Description of the Prior Art

Stainless steel has high corrosion resistance, and is used in various industrial fields. However, when stainless steel is used in an atmosphere of high chloride ion, for example used in seawater or a flue gas desulfurization apparatus, serious corrosion such as crevice corrosion tends to appear, so that a wide used stainless steel such as SUS 304 and SUS 316 and the like is restricted to use. Therefore, some trials for improvement of corrosion resistance have been made by increasing content of Cr and/or Mo, and/or adding N. For example, Japanese Laid Open No. 1977-95524 typically discloses an austenite stainless steel including more than 6.0% by weight of Mo. However, when content of Cr or Mo is much, intermetallic compound such as σ phase and χ phase and the like tends to precipitate in casting which is one of process of manufacturing stainless steel. As a result, lack of Cr or Mo partially appears in a matrix of the stainless steel, this result in decrease of corrosion resistance and hot workability. The decrease of hot workability appears in a way that intermetallic compound does not disappear during heating for hot rolling, so that an end of a hot rolled plate breaks into two in the direction of thickness thereof (hereinafter, call it "breaking into two").

In order to avoid precipitate of intermetallic compound such as a phase and the like, for example Japanese Patent Publication No. 1982-28740 proposes to increase amount of addition of N. However, increase of content of N result in increase of deformation resistance in hot, so that hot rolling can not be carried out in some cases. Therefore, as disclosed in for example Japanese Laid Open No. 1987-192530, it is proposed to introduce a soaking process before and after a hot rolling so as to change precipitate such as intermetallic compound into a matrix which does not influence too much upon the quality of the material and corrosion resistance even if the chemical composition of the alloy is easy to precipitates intermetallic compound such as σ phase and the like. However, introduction of soaking process result in increase of manufacturing cost, this may be a serious obstacle for practical use.

SUMMARY OF THE INVENTION

Therefore, it is an object of the present invention to provide an austenite stainless steel which can restrain precipitate of intermetallic compound such as phase and the like so as to obtain high hot workability and crevice corrosion resistance in an atmosphere including heavy chloride ion, and to avoid increase of manufacturing cost.

The inventors of the present invention made detailed research with respect to chemical composition of austenite stainless steel observing appearance of crevice corrosion and amount of precipitate of intermetallic compound therein. Consequently, the inventors found that in order to fit for use stainless steel in seawater or a flue gas desulfurization apparatus, the stainless steel must have at least corrosion resistance at a temperature of not less than 60° C. More over, the inventors found that Cr, Mo and N improved crevice corrosion resistance, amount of the elements was [Cr+3.3Mo+20N (wherein "Cr", "Mo" and "N" mean content of each element (wt %))] when the elements were weighted respectively so that the elements became essentially equivalent considering contribution to improvement of corrosion resistance, and the amount of the elements must be not less than 51 in order to have corrosion resistance in the above atmosphere.

However, intermetallic compound further precipitates when content of Cr and Mo increase as mentioned the above. Therefore, the inventors thought of decreasing content of Si and Mn as small as possible compared to the ordinary level. That is to say, Cr and Mo bond with Fe and form intermetallic compound, and Si and Mn contribute to formation of intermetallic compound. The inventors found that amount of the elements was [5Si+Mn] when the elements were weighted respectively so that the elements became essentially equivalent considering contribution to formation of intermetallic compound, and that when the amount of the elements [5Si+Mn] was less than [32−(Cr+Mo)(wherein "Cr", "Mo", "Si" and "Mn" mean content of each element (wt %))], precipitate of intermetallic compound during solidification was restrained, and decrease of hot workability such as breaking into two hardly appeared. That is to say, the inventors had new knowledge that existence of Si and Mn remarkably contributed to increase of precipitate of intermetallic compound due to increase of content of Cr and Mo, on the other hand, by remarkably decreasing content of Si and Mn, precipitate of intermetallic compound was restrained even high Cr steel and high Mo steel.

The austenite stainless steel according to the present invention is completed based on the above mentioned knowledge.

In accordance with the present invention, there is provided an austenite stainless steel, the austenite stainless steel comprising: no more than 0.05% by weight of C; no more than 0.25% by weight of Si; no more than 0.40% by weight of Mn; no more than 0.040% by weight of P; no more than 0.003% by weight of S; 30.0 to 40.0% by weight of Ni; 20.0 to 26.0% by weight of Cr; 5.0 to 8.0% by weight of Mo; no more than 0.1% by weight of Al; 0.001 to 0.010% by weight of B; 0.15 to 0.30% by weight of N; and balance of Fe and inevitable impurity; the austenite stainless steel satisfying formulas (1) and (2) mentioned below (wherein "Cr", "Mo", "N", "Si" and "Mn" mean content of each element (wt %)).

$$Cr+3.3Mo+20N \geqq 51 \quad (1)$$

$$5Si+Mn<32-(Cr+Mo) \quad (2)$$

In the following, the reason of the above numerical limitation will be explained together with effect of the present invention.

C: Content of C should be small since C decreases corrosion resistance. However, extremely decreasing content of C result in increase of manufacturing cost of the stainless steel. Content of C is allowable to the extent of 0.05% by weight, and therefore, the maximum limitation of C is set at 0.05% by weight.

Si: Content of Si should similarly be as small as possible in order to restrain precipitate of intermetallic compound such as σ phase and χ phase and the like, so that content of Si should be no more than 0.25% by weight. Content of Si is preferably no more than 0.20% by weight, more preferably is no more than 0.10% by weight.

Mn: Content of Mn should be as small as possible in order to restrain precipitate of intermetallic compound such as σ phase and χ phase and the like, so that content of Mn should be no more than 0.40% by weight. Content of Mn is preferably no more than 0.30% by weight, more preferably is no more than 0.20% by weight.

P: P is included as an inevitable impurity in the stainless steel. P is easy to partially precipitate at grain boundary of matrix of the stainless steel, so that content of P should be as small as possible in order to obtain corrosion resistance and hot workability. However, extremely decreasing content of P result in increase of manufacturing cost of the stainless steel. Contend of P is allowable to the extent of 0.04% by weight. Therefore, the maximum limitation of P is set at 0.04% by weight. Content of P is preferably no more than 0.03% by weight.

S: S is included as an inevitable impurity in the stainless steel similarly as P. S is easy to partially precipitate at grain boundary of matrix of the stainless steel, so that content of S should be as small as possible in order to obtain corrosion resistance and hot workability. Particularly, harmfulness of S remarkably appears when content thereof exceeds 0.003% by weight. Therefore, content of S is set in the range of no more than 0.003% by weight. Preferably, content of S is no more than 0.002% by weight.

Ni: Ni is an effective element for restraining precipitate of intermetallic compound such as σ phase and χ phase and the like. When content of Ni is less than 30.0% by weight, δ ferrite is generated and further intermetallic compound precipitates. On the other hand, when content of Ni is more than 40.0 10 by weight, hot workability becomes declined and hot deformation resistance become large. Therefore, content of Ni is set in the range of 30.0 to 40.0% by weight.

Cr: Cr is an effective element for increasing crevice corrosion resistance, which is obtained when content of Cr is not less than 20.0% by weight. However, when Cr is included exceeding 26.0% by weight, intermetallic compound such as σ phase and χ phase and the like are retained, so that crevice corrosion resistance is contrary declined. Therefore, content of Cr is set in the range of 20.0 to 26.0% by weight. Content of Cr is preferably not less than 22.0% by weight, more preferably is not less than 23.0% by weight.

Mo: Mo is similarly an effective element for increasing crevice corrosion resistance, which is obtained when content of Mo is not less than 5.0% by weight. However, when Mo is included exceeding 8.0% by weight, advantage obtained by decreasing content of Si and Mn is hardly obtained, so that precipitate of intermetallic compound can not be restrained. Therefore, content of Mo is set in the range of 5.0 to 8.0% by weight. Content of Mo is preferably not less than 6.0% by weight, more preferably is not less than 7.0% by weight.

Al: Al is heavy deoxidizer. In the present invention, content of Si and Mn which similarly have deoxidizing function are small, so that Al should be actively added. However, when Al is included exceeding 0.10% by weight, further intermetallic compound precipitate. Therefore, content of Al is set in the range of no more than 0.10% by weight.

B: B is an element remarkably effective for increasing hot workability, which is obtained when content of B is not less than 0.001% by weight. However, when B is included exceeding 0.010% by weight, hot workability is contrary declined. Therefore, content of B is set in the range of 0.001 to 0.010% by weight.

N: N is an effective element for increasing crevice corrosion resistance as well as Cr and Mo, and restraining precipitate of intermetallic compound. Such advantages are obtained when content of N is not less than 0.15% by weight. However, when N is included exceeding 0.30% by weight, hot deformation resistance remarkably increases, so that hot workability of the stainless steel is declined. Therefore, content of N is set in the range of 0.15 to 0.30% by weight.

Thus, the austenite stainless steel having the above chemical composition can restrain precipitate of intermetallic compound such as σ phase and the like, so that superior hot workability and crevice corrosion resistance can be obtained in an atmosphere of high chloride ion density. Furthermore, the stainless steel does not need soaking process for calming intermetallic compound, so that the stainless steel can be manufactured without cost increasing.

As mentioned the above, the amount of the elements (5Si+Mn) in which content of Si and Mn are weighted is important factor in order to restrain precipitate of intermetallic compound. The inventors carried out various experiments, and found that precipitate of intermetallic compound was certainly restrained when the amount (5Si+Mn) was no more than 1.3% by weight. Therefore, the amount (5Si+Mn) should be no more than 1.3% by weight.

Furthermore, the amount of the elements (Cr+Mo) is not neglectful factor in order to improve crevice corrosion resistance. The inventors carried out various experiments, and found that crevice corrosion resistance was remarkably stable when the amount of Cr and Mo was not less than 29% by weight, and that precipitate of intermetallic compound was remarkably decreased when the amount of Cr and Mo was no more than 32% by weight. Therefore, the amount of Cr and Mo should be 29 to 32% by weight.

In addition, the present invention can further include at least one of element selected from the group consisting of 0.01 to 1.0% by weight of Cu, 0.01 to 1.0 % by weight of W and 0.01 to 1.0% by weight of Co. These elements are effective for increasing ordinary corrosion resistance, which is obtained when content of the element is not less than 0.01% by weight. However, when content of the element is more than 1.0% by weight, hot workability of the stainless steel is declined. Therefore, content of the element is set in the range of 0.01 to 1.0% by weight.

The features and advantages of the austenite stainless steel will be more clearly understood from the following description of preferred embodiments of the present invention taken in conjunction with the accompanying drawings.

DETAILED DESCRIPTION OF THE PRESENT INVENTION

A. Embodiment 1

The following is description of the first embodiment according to the present invention. Twelve kinds of steel samples including about 35% by weight of Ni and about 0.2% by weight of N were melted by an air smelting furnace and casted with 5 kg per each sample. Forging, cold rolling and solution heat treatment were carried out to each sample, so that twelve cold rolled plates with thickness of 2 mm were manufactured. Then, test piece was picked from the cold rolled plate, the test piece was sandwitched by a pair of Teflon column against both surface thereof. In this condition, the test piece was dipped into a solution of 6% $FeCl_3$+1/20NHCl for 24 hours. This experiment was carried out at various temperature of the solution, and checked critical temperature in which crevice corrosion did not appear.

Density of chloride ion of the solution used in the crevice corrosion test was about 41,000 ppm, which is higher than that of seawater. Moreover, the solution included $Fe^{3+}$ ion which functioned as an oxidant, so that oxidation-reduction potential of the solution remarkably increased, and the potential of the solution was higher than that of seawater. Therefore, when crevice corrosion did not appear in the test, it could be recognized that crevice corrosion would not appear in seawater at the temperature of the test.

Figure 1:
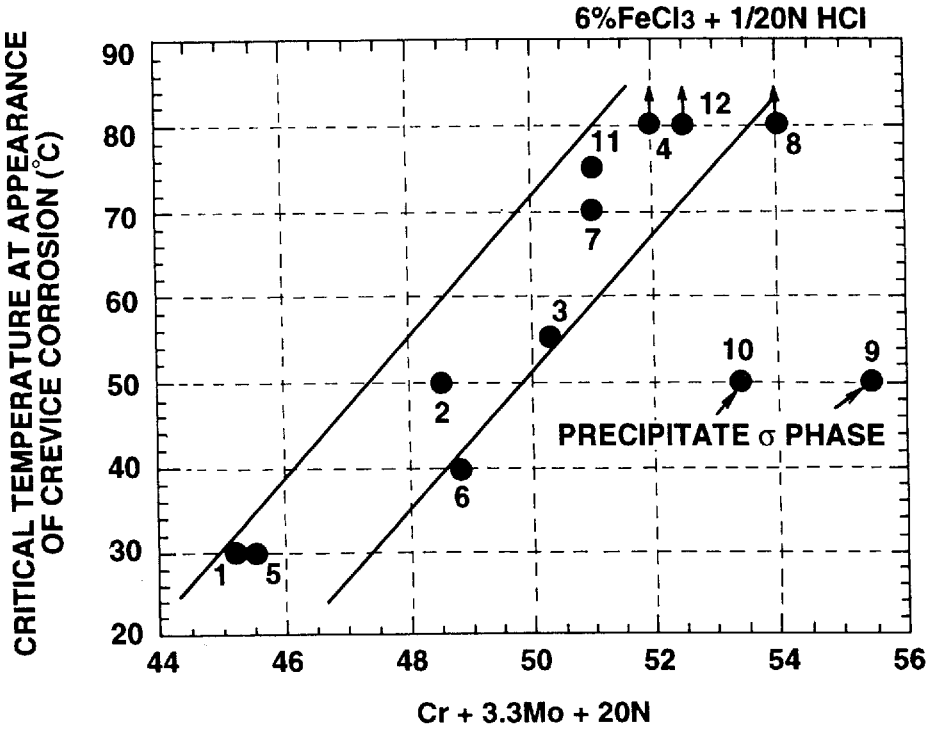
FIG. 1 is a diagram showing relationship between amount of Cr, Mo and N and critical temperature at appearance of crevice corrosion.

Chemical composition of Sample Nos. 1 to 12 and critical temperature at appearance of crevice corrosion are shown in Table 1. Amount of the elements (Cr+3.3Mo+20N) in which content of Cr, Mo and N are weighted are shown in Table 1 together. Relationship between the amount and the critical temperature at appearance of crevice corrosion are shown in FIG. 1. Wherein, the subscript associated to the black circle indicates the number of the sample.

As mentioned the above, in order to obtain enough crevice corrosion resistance in seawater and a flue gas desulfurization apparatus, critical temperature at appearance of crevice corrosion is required to be not less than 60° C. As clearly shown in Table 1 and FIG. 1, Samples Nos. 4, 7 and 8 in which the chemical composition were in the range of the present invention satisfied the above requirement. In Sample Nos. 11 and 12, the content of the element without N were in the range of the invention, so that the critical temperature at appearance of crevice corrosion was more than 60° C.

B. Embodiment 2

Figure 2:
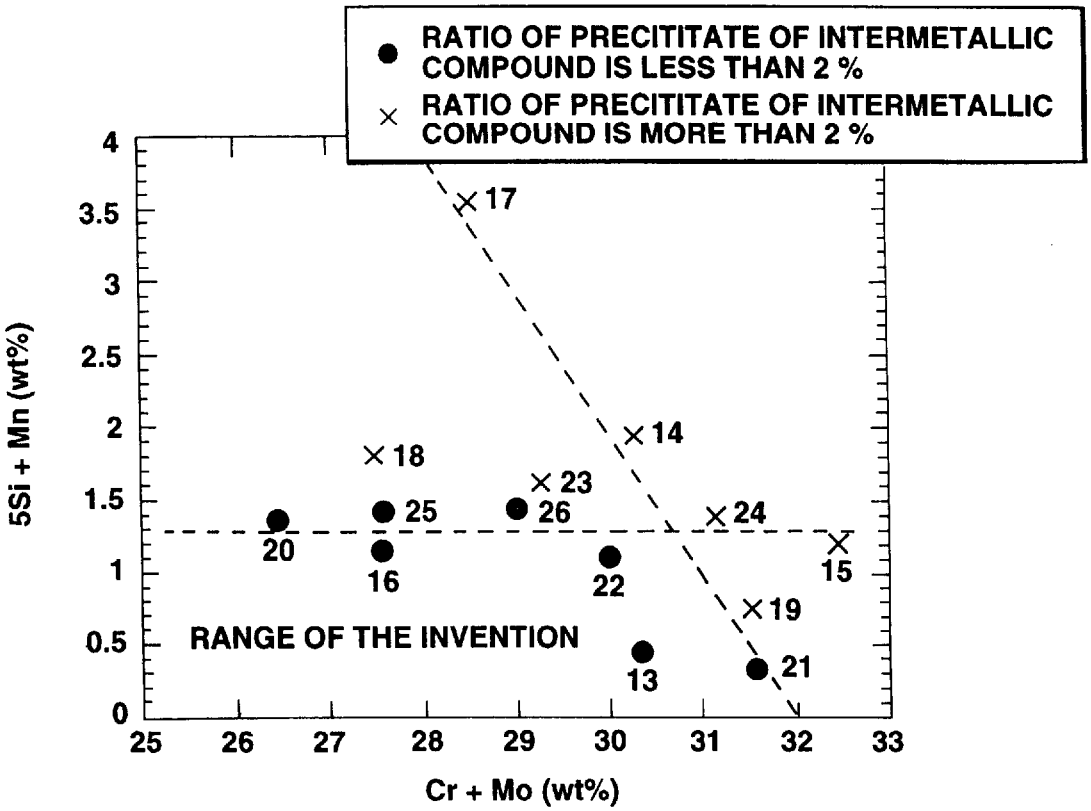
FIG. 2 is a diagram showing the amount of Cr, and Mo along the horizontal axis and the amount of Si and Mn along the vertical axis.

Alloys having chemical composition shown in Table 2 were melted in an air induction furnace, and fourteen kinds of steel samples including about 35% by weight of Ni and about 0.2% by weight of N were casted with 5 kg per each sample. In industrial scale casting, ingot is manufactured by continuous casting. The condition of the solidification of the embodiment was adjusted so that the cooling speed thereof was equivalent to that of the continuous casting. The ratio of precipitate of intermetallic compound such as σ phase and χ phase and the like precipitated at the center portion of the ingot with a weight of 5 kg was calculated. Wherein, the ratio of precipitate was calculated in a way that a view in a microscope was divided into lattice-shape, lattice points overlapping with intermetallic compound were counted, and ratio of the overlapping points with respect to the number of the entire lattice points was calculated. Then, hot rolling was carried out to the samples, and appearance of breaking into two at the rear end of the hot rolled plate was observed. Relationship between the ratio of precipitate and appearance of breaking into two is shown in Table 2 together. Furthermore, the amount of the elements (5Si+Mn) in which content of Si and Mn are weighted, and amount of Cr and Mo are shown in Table 2 together. The amounts are plotted along the vertical axis and the horizontal axis respectively in FIG. 2. The result of the observation of Sample Nos. 13 to 26 are shown in FIG. 2 together. Wherein, the subscript associated with the black circle and the sign "X" indicates the number of sample.

TABLE 1

| Sample No. | C | Si | Mn | P | S | Ni | Cr | Mo | N | B | Al | Cr + 3.3Mo + 20N | Critical Temperature at Appearance of Crevice Corrosion (°C.) |
|---|---|---|---|---|---|---|---|---|---|---|---|---|---|
| 1* | 0.012 | 0.11 | 0.22 | 0.018 | 0.0007 | 30.87 | 22.93 | 5.48 | 0.20 | 0.0032 | 0.011 | 45.0* | 30 |
| 2* | 0.010 | 0.13 | 0.21 | 0.018 | 0.0006 | 31.00 | 22.98 | 6.44 | 0.21 | 0.0035 | 0.009 | 48.4* | 50 |
| 3* | 0.010 | 0.14 | 0.20 | 0.018 | 0.0003 | 30.99 | 22.98 | 6.94 | 0.23 | 0.0041 | 0.016 | 50.4* | 55 |
| 4 | 0.010 | 0.11 | 0.21 | 0.018 | 0.0002 | 30.95 | 23.06 | 7.43 | 0.22 | 0.0033 | 0.012 | 52.0 | More than 80 |
| 5* | 0.010 | 0.12 | 0.20 | 0.018 | 0.0002 | 31.00 | 19.99* | 6.46 | 0.20 | 0.0023 | 0.022 | 45.2* | 30 |
| 6* | 0.010 | 0.10 | 0.20 | 0.018 | 0.0003 | 30.96 | 20.10 | 7.42 | 0.21 | 0.0029 | 0.019 | 48.6* | 40 |
| 7 | 0.012 | 0.10 | 0.21 | 0.018 | 0.0002 | 30.98 | 25.00 | 6.46 | 0.24 | 0.0033 | 0.014 | 51.1 | 70 |
| 8 | 0.011 | 0.11 | 0.22 | 0.019 | 0.0002 | 30.93 | 25.01 | 7.40 | 0.24 | 0.0045 | 0.016 | 54.1 | More than 80 |
| 9* | 0.012 | 0.12 | 0.23 | 0.019 | 0.0004 | 30.86 | 28.19* | 6.46 | 0.24 | 0.0030 | 0.020 | 54.2 | 50 |
| 10* | 0.012 | 0.13 | 0.23 | 0.020 | 0.0004 | 30.80 | 30.28* | 5.51 | 0.25 | 0.0042 | 0.018 | 53.4 | 50 |
| 11* | 0.012 | 0.11 | 0.21 | 0.018 | 0.0003 | 31.07 | 23.02 | 6.45 | 0.34* | 0.0038 | 0.015 | 51.0 | 75 |
| 12* | 0.014 | 0.12 | 0.22 | 0.018 | 0.0004 | 31.04 | 23.06 | 6.44 | 0.41* | 0.0028 | 0.014 | 52.5 | More than 80 |

*indicates beyond the range of the Invention

Wherein, in Sample Nos. 11 and 12, the content of N were above the range of the invention (the maximum limitation is 0.3% by weight), so that decline of hot workability was forecasted.

Furthermore, as shown in FIG. 1, in Sample Nos. 9 and 10, the critical temperature at appearance of crevice corrosion was 50° C. although amount of Cr, Mo and N was large. The reason is that the content of Cr was above the range of the invention (the maximum limitation is 26% by weight), so that intermetallic compound such as phase and the like precipitated, and crevice corrosion resistance declined. As can understand from the above, except for Sample Nos. 9 and 10, in order to make critical temperature at appearance of crevice corrosion to be not less than 60° C., amount of Cr, Mo and N required to be not less than 51% by weight, this proofs the reason of the numerical limitation of the invention.

As can understand from Table 2, in Sample Nos. 13, 16, 20 to 22, 25 and 26, the ratio of precipitate were less than 2%, and breaking into two did not appear. Particularly, in Sample Nos. 13, 21, 22 and 26, content of Si was less than 0.25% by weight and content of Mn was less than 0.40% by weight, these level of content were remarkably small. Therefore, in these samples, precipitate of intermetallic compound were sufficiently restrained although content of Cr and Mo were large. On the contrary, in other samples in which content of chemical composition were not in the range of the invention, the ratio of precipitate of intermetallic compound were more than 2%, and breaking into two were appeared on all the samples. Particularly, in Sample No. 18, the ratio of precipitate was more than 2% although content of Cr and Mo was not so large. The reason is that content of Mn was 0.55% by weight, which exceeded 0.4% by weight which is the maximum limitation of the invention.

TABLE 2

| Sample No. | C | Si | Mn | P | S | Ni | Cr | Mo | N | B | Al | 5Si + Mn | Cr + Mo | 32 − (Cr + Mo) | Appearance of Breaking into two | Ratio of Precipitation |
|---|---|---|---|---|---|---|---|---|---|---|---|---|---|---|---|---|
| 13 | 0.011 | 0.05 | 0.21 | 0.021 | 0.0005 | 35.48 | 22.89 | 7.45 | 0.21 | 0.0037 | 0.015 | 0.46 | 30.34 | 1.66 | No | 0.4% |
| 14* | 0.009 | 0.35* | 0.20 | 0.022 | 0.0009 | 35.34 | 22.96 | 7.33 | 0.23 | 0.0039 | 0.014 | 1.95 | 30.29 | 1.71* | Appear | 3.3% |
| 15* | 0.013 | 0.16 | 0.42* | 0.022 | 0.0008 | 34.97 | 25.01 | 7.40 | 0.20 | 0.0033 | 0.014 | 1.22 | 32.51 | −0.51* | Appear | 7.6% |
| 16 | 0.010 | 0.18 | 0.26 | 0.020 | 0.0010 | 34.99 | 21.42 | 6.13 | 0.21 | 0.0035 | 0.008 | 1.16 | 27.55 | 4.45 | No | 0.6% |
| 17* | 0.011 | 0.54* | 0.86* | 0.020 | 0.0011 | 35.20 | 22.54 | 5.95 | 0.21 | 0.0028 | 0.021 | 3.51 | 28.49 | 3.51* | Appear | 5.4% |
| 18* | 0.012 | 0.25 | 0.55* | 0.021 | 0.0008 | 35.11 | 20.93 | 6.56 | 0.22 | 0.0026 | 0.018 | 1.80 | 27.49 | 4.51 | Appear | 2.4% |
| 19* | 0.012 | 0.12 | 0.15 | 0.020 | 0.0006 | 34.95 | 26.21* | 5.35 | 0.24 | 0.0034 | 0.016 | 0.75 | 31.56 | 0.44* | Appear | 2.6% |
| 20 | 0.013 | 0.23 | 0.22 | 0.023 | 0.0012 | 35.06 | 20.63 | 5.85 | 0.23 | 0.0042 | 0.015 | 1.37 | 26.48 | 5.52 | No | 0.9% |
| 21 | 0.009 | 0.04 | 0.12 | 0.021 | 0.0011 | 34.86 | 24.00 | 7.58 | 0.19 | 0.0040 | 0.016 | 0.32 | 31.58 | 0.42 | No | 0.4% |
| 22 | 0.009 | 0.17 | 0.26 | 0.022 | 0.0010 | 35.37 | 23.62 | 6.39 | 0.21 | 0.0036 | 0.019 | 1.11 | 30.01 | 1.89 | No | 0.3% |
| 23* | 0.010 | 0.28* | 0.20 | 0.021 | 0.0007 | 34.88 | 22.92 | 6.32 | 0.21 | 0.0037 | 0.018 | 1.60 | 29.24 | 2.76 | Appear | 2.8% |
| 24* | 0.011 | 0.22 | 0.28 | 0.023 | 0.0009 | 33.65 | 24.45 | 6.83 | 0.22 | 0.0039 | 0.018 | 1.38 | 31.28 | 0.72* | Appear | 3.6% |
| 25 | 0.009 | 0.23 | 0.26 | 0.020 | 0.0070 | 32.57 | 21.71 | 5.89 | 0.20 | 0.0036 | 0.014 | 1.41 | 27.60 | 4.40 | No | 1.1% |
| 26 | 0.012 | 0.24 | 0.23 | 0.020 | 0.0050 | 34.48 | 22.58 | 6.01 | 0.23 | 0.0035 | 0.011 | 1.43 | 28.59 | 3.41 | No | 1.0% |

*indicates beyond the range of the invention

Following is detailed analysis of the embodiment according to FIG. 2. As shown in FIG. 2, samples which could obtain sufficient result and other samples which could not obtain sufficient result are clearly distributed on two ranges which are distinct by the dotted diagonal line indicated by the following formula (2).

$$5Si+Mn<32-(Cr+Mo) \quad (2)$$

(Wherein, "Cr", "Mo", "N", "Si" and "Mn" mean content of each element (wt %)).

In the samples distributed on the right side range of the dotted diagonal line, that is to say, in Sample Nos. 14, 15, 17, 19 and 24 which did not satisfy formula (2), the rate of precipitate were entirely more than 2%, and breaking into two appeared. Particularly, in Sample No. 24 in which content of Cr, Mo, N, Si and Mn did not satisfy formula (2) although each content of C to Al was in the range of the invention, further intermetallic compound precipitated. This result essentially proved formula (2), and confirmed reliability of the numerical limitation of the invention.

In addition, Sample Nos. 18 and 23 satisfied formula (2). However, in Sample 18 in which content of Mn exceeded the range of the invention, in Sample No. 23 in which content of Si exceeded the range of the invention, further intermetallic compound precipitated.

In samples which could obtain satisfied result, in Sample Nos. 20, 25 and 26, the ratio of precipitate was about 1.0%. However, in other samples in which satisfied result was obtained, the highest ratio of precipitate was 0.6%, which was remarkably small level. As clearly shown in FIG. 2, these samples having small ratio of precipitate was clearly distinct by the condition that whether the amount of content of the elements (5Si+Mn) in which content of Si and Mn were weighted exceeds 1.3% by weight of or not. That is to say, when the amount (5Si+Mn) was no more than 1.3% by weight, as shown in the result of the embodiment, precipitate of intermetallic compound was remarkably restrained. As mentioned the above, the result of the embodiment confirmed reliability of the reason of the numerical limitation of the invention.

C. Embodiment 3

Alloys having chemical composition shown in Table 3 were melted in an air induction furnace, and ten kinds of ingots with a weight of 10 kg were manufactured. The ingots were heated at a temperature up speed of 1200° C./hr, after temperature up, the ingots were hot rolled so as to form hot rolled plates having a thickness of 6 mm. A solution heat treatment were carried out to the hot rolled plates in a way that the hot rolled plates were heated at a temperature of 1150° C. for 30 minutes, then the hot rolled plates were water cooled. Then the plates were cold rolled to have a thickness of 2 mm, and a heat treatment at a temperature of 1150° C. for 1 minute was carried out to the plates. Then, various valuation tests mentioned below were carried out. The results of the tests are shown in Table 4.

(1) Degree of precipitate of intermetallic compound

Ratio of precipitate of intermetallic compound such as σ phase and χ phase and the like precipitated at the center portion of the ingot with a weight of 10 kg was calculated.

(2) Hot workability

Appearance of breaking into two at the rear end of hot rolled plate was observed after hot rolling.

(3) Crevice corrosion resistance

Test piece picked from the cold rolled plate with thickness of 2 mm was sandwitched by a pair of Teflon column against both surface of the test piece, which was dipped into a solution of 6% $FeCl_3$+1/20NHCl for 24 hours. This experiment was carried out at various temperature of the solution, and critical temperature in which crevice corrosion did not appear was checked.

TABLE 3

| Sample No. | Section | C | Si | Mn | P | S | Ni | Cr | Mo | Cu | Al | Co | W | N | B |
|---|---|---|---|---|---|---|---|---|---|---|---|---|---|---|---|
| 27 | Invented | 0.010 | 0.12 | 0.23 | 0.021 | 0.0014 | 35.02 | 22.86 | 7.55 | 0.02 | 0.019 | 0.01 | 0.01 | 0.21 | 0.0036 |
| 28 | Steel | 0.012 | 0.04 | 0.06 | 0.020 | 0.0016 | 33.63 | 25.51 | 6.20 | 0.01 | 0.020 | 0.01 | 0.01 | 0.28 | 0.0025 |
| 29 | | 0.025 | 0.16 | 0.19 | 0.021 | 0.0010 | 38.51 | 21.83 | 7.84 | 0.01 | 0.009 | 0.01 | 0.02 | 0.17 | 0.0033 |
| 30 | | 0.032 | 0.14 | 0.22 | 0.019 | 0.0008 | 34.96 | 23.02 | 7.46 | 0.52 | 0.014 | 0.01 | 0.01 | 0.19 | 0.0035 |
| 31 | | 0.010 | 0.09 | 0.21 | 0.024 | 0.0009 | 36.11 | 23.15 | 7.72 | 0.01 | 0.013 | 0.46 | 0.02 | 0.24 | 0.0048 |

TABLE 3-continued

| Sample No. | Section | C | Si | Mn | P | S | Ni | Cr | Mo | Cu | Al | Co | W | N | B |
|---|---|---|---|---|---|---|---|---|---|---|---|---|---|---|---|
| 32 | | 0.008 | 0.09 | 0.22 | 0.020 | 0.0012 | 35.38 | 22.96 | 7.14 | 0.01 | 0.014 | 0.01 | 0.63 | 0.23 | 0.0051 |
| 33 | Comparative | 0.006 | 0.08 | 0.24 | 0.025 | 0.0008 | 34.23 | 27.24* | 6.13 | 0.02 | 0.016 | 0.02 | 0.02 | 0.22 | 0.0039 |
| 34 | Steel | 0.015 | 0.38* | 0.52* | 0.022 | 0.0009 | 36.14 | 22.92 | 6.85 | 0.02 | 0.022 | 0.01 | 0.01 | 0.28 | 0.0043 |
| 35 | | 0.014 | 0.04 | 0.16 | 0.021 | 0.0011 | 34.74 | 25.34 | 3.63* | 0.01 | 0.018 | 0.01 | 0.01 | 0.24 | 0.0026 |
| 36 | | 0.023 | 0.14 | 0.14 | 0.022 | 0.0011 | 33.92 | 19.47* | 5.83 | 0.01 | 0.015 | 0.01 | 0.01 | 0.19 | 0.0038 |

*indicates beyond the range of thc invention

As clearly shown in Table 4, in all Sample Nos. 27 to 32 in which chemical compositions were in the range of the present invention, the ratio of appearance of intermetallic compound were less than 2%, and breaking into two did not appear, and the critical temperature at appearance of crevice corrosion were more than 60° C., superior hot workability and crevice corrosion resistance were indicated. Particularly in the all invented stainless steels in the embodiment, the critical temperature at appearance of crevice corrosion were stably more than 70° C., and the highest ratio of precipitate of intermetallic compound was 0.3% which were substantially less than 2%. The reason is consumed that in the samples, amount of Si and Mn were no more than 1.3% by weight, amount of Cr and Mo were 29 to 32% by weight, and content of Cu, W and Co were 0.01 to 1.0% by weight respectively.

TABLE 4

| Sample No. | Section | Cr + 3.3Mo + 20N | Critical Temperature at Appearance of Crevice Corrosion | 5Si + Mn | Cr + Mo | 32 − (Cr + Mo) | Appearance of Breaking into Two | Ratio of Precipitation |
|---|---|---|---|---|---|---|---|---|
| 27 | Invented | 52.0 | More than 80 | 0.83 | 30.41 | 1.59 | No | 0.3% |
| 28 | Steel | 51.0 | 75 | 0.10 | 31.37 | 0.19 | No | 0 |
| 29 | | 51.1 | 70 | 0.99 | 29.67 | 2.33 | No | 0.2% |
| 30 | | 51.4 | 70 | 0.92 | 30.48 | 1.52 | No | 0.2% |
| 31 | | 53.4 | More than 80 | 0.66 | 30.87 | 1.13 | No | 0.1% |
| 32 | | 51.1 | 65 | 0.67 | 30.10 | 1.90 | No | 0.1% |
| 33 | Comparative | 51.9 | More than 80 | 0.64 | 33.37 | −1.37 | Appear | 5.6% |
| 34 | Steel | 51.1 | 70 | 2.42 | 29.77 | 2.23 | Appear | 3.9% |
| 35 | | 58.6 | More than 80 | 0.36 | 33.97 | −1.97 | Appear | 7.4% |
| 36 | | 42.5 | 40 | 0.93 | 25.30 | 6.70 | No | 0 |

On the contrary, in comparative Sample Nos. 33 to 35, amount of Si and Mn were large, that is to say, these Samples did not satisfy (5Si+Mn<32−(Cr+Mo)), so that the ratio of precipitate of intermetallic compound were large, and breaking into two was appeared on the all samples. Furthermore, in Sample No. 36, precipitate of intermetallic compound and breaking into two were not appear since amount of Si and Mn was small. However, in Sample No. 36, (Cr+3.3Mo+20N) was less than 51% by weight, so that the critical temperature at appearance of crevice corrosion was only 40° C.

As described the above, in the austenite stainless steel of the present invention, amount of Cr, Mo and N are originally weighted and ensured necessary amount, and amount of Si and Mn is set small, so that precipitate of intermetallic compound such as σ phase and χ phase and the like is restrained, superior hot workability and crevice corrosion resistance in an atmosphere of high density of chloride ion are obtained, increase of manufacturing cost can be avoided.

What is claimed is:

1. An austenite stainless steel comprising:

no more than 0.05% by weight of C; no more than 0.25% by weight of Si; no more than 0.40% by weight of Mn; no more than 0.040% by weight of P; no more than 0.003% by weight of S; 30.0 to 40.0% by weight of Ni; 20.0 to 26.0% by weight of Cr; 5.0 to 8.0% by weight of Mo; no more than 0.1% by weight of Al; 0.001 to 0.010% by weight of B; 0.15 to 0.30% by weight of N; and balance being Fe and inevitable impurities; said austenite stainless steel satisfying formulas (1) and (2):

$$Cr+3.3Mo+20N \geqq 51 \quad (1)$$

$$5Si+Mn<32-(Cr+Mo) \quad (2)$$

2. An austenite stainless steel according to claim 1, wherein said austenite stainless steel satisfies formula (3) mentioned below.

$$5Si+Mn \leqq 1.3 \quad (3)$$

3. An austenite stainless steel according to claim 2, wherein said austenite stainless steel further comprises at least one of element selected from the group consisting of: 0.01 to 1.0% by weight of Cu; 0.01 to 1.0% by weight of W; 0.01 to 1.0% by weight of Co.

4. An austenite stainless steel according to claim 3, wherein content of Si is no more than 0.20% by weight, and content of Mn is no more than 0.30% by weight.

5. An austenite stainless steel according to claim 4, wherein content of Si is no more than 0.10% by weight, and content of Mn is no more than 0.20% by weight.

6. An austenite stainless steel according to claim 5, wherein content of Cr is not less than 22.0% by weight, and content of Mo is not less than 6.0% by weight.

7. An austenite stainless steel according to claim 6, wherein content of Cr is not less than 23.0% by weight, and content of Mo is not less than 7.0% by weight.

8. An austenite stainless steel according to claim 6, wherein the total amount of Cr and Mo is 29 to 32% by weight.

9. An austenite stainless steel according to claim 1, wherein content of Si is 0.04 to ≦0.25% by weight, and content of Mn is 0.06 to 0.40% by weight.

* * * * *